United States Patent [19]

Ikuta et al.

[11] Patent Number: 5,074,413

[45] Date of Patent: Dec. 24, 1991

[54] CARRYING CASE

[75] Inventors: Tamao Ikuta, Yokohama; Richard Nibley, Tokyo; Seiichi Omino, Hoya, all of Japan

[73] Assignee: Canon Kabushiki Kaisha, Tokyo, Japan

[21] Appl. No.: 544,069

[22] Filed: Jun. 26, 1990

Related U.S. Application Data

[63] Continuation of Ser. No. 40,761, Apr. 20, 1987, abandoned, which is a continuation-in-part of Ser. No. 664,492, Oct. 25, 1984, abandoned.

[30] Foreign Application Priority Data

Oct. 31, 1983 [JP] Japan ..... 58-202823
Oct. 31, 1983 [JP] Japan ..... 58-202824

[51] Int. Cl.[5] ..... A45C 11/00; A45C 13/10; A45C 13/26; B65D 85/38

[52] U.S. Cl. ..... 206/320; 190/115; 190/117; 190/118; 190/119; 400/715

[58] Field of Search ..... 190/18 A, 115, 111, 190/117, 119, 118; 206/305, 235, 320; 400/691, 715; 312/208, 244; D3/73; D18/2, 11, 12, 22; D14/114

[56] References Cited

U.S. PATENT DOCUMENTS

| | | | |
|---|---|---|---|
| D. 234,545 | 3/1975 | De Tomaso | D3/73 |
| D. 245,479 | 8/1977 | Malcolm | D3/73 X |
| D. 271,725 | 12/1983 | Sherer | D3/73 |
| D. 272,545 | 2/1984 | Latino | D18/12 |
| 711,881 | 10/1902 | Rubens | 190/18 R |
| 803,732 | 11/1905 | Turner | 190/119 X |
| 1,246,203 | 11/1917 | Willman | 312/208 X |
| 2,105,559 | 1/1938 | Stelljes | 190/118 X |
| 2,453,663 | 11/1948 | Hinson | 190/100 |
| 2,596,652 | 5/1952 | Chuilicek | 312/208 |
| 2,684,135 | 7/1954 | Cart | 190/113 |
| 2,716,473 | 8/1955 | Droutman | 190/119 |
| 2,933,849 | 4/1960 | Gaiser et al. | 312/208 |
| 3,339,781 | 9/1967 | Schurman et al. | 190/18 R X |
| 3,382,526 | 5/1968 | Ryan et al. | 16/110 R X |
| 3,642,102 | 2/1972 | Furniss et al. | 190/118 X |
| 3,739,886 | 6/1973 | Kertzman | 190/115 X |
| 3,781,075 | 12/1973 | Fresard | 312/208 |
| 3,822,083 | 7/1974 | Zeamer | 312/208 |
| 3,861,556 | 1/1975 | Barecki et al. | 206/216 |
| 3,891,070 | 6/1975 | Montanari | 190/117 |
| 4,071,065 | 1/1978 | Halbich | 206/305 X |
| 4,482,064 | 11/1984 | Berke et al. | 400/715 X |

FOREIGN PATENT DOCUMENTS

| | | | |
|---|---|---|---|
| 1777450 | 10/1958 | Fed. Rep. of Germany | |
| 1457226 | 5/1969 | Fed. Rep. of Germany | |
| 2255296 | 5/1974 | Fed. Rep. of Germany | 150/55 |
| 90074 | 8/1967 | France | 150/55 |
| 331951 | 7/1930 | United Kingdom | 312/208 |
| 517089 | 1/1940 | United Kingdom | 190/18 R |
| 1220661 | 1/1971 | United Kingdom | 312/208 |
| 2074948 | 11/1981 | United Kingdom | 400/715 |

*Primary Examiner*—Sue A. Weaver
*Attorney, Agent, or Firm*—Fitzpatrick, Cella, Harper & Scinto

[57] ABSTRACT

Carrying case having a grip portion which is so constructed as to hold the upper and lower lid members whereby the locked state of the carrying case is maintained during transportation by the holding force of the operator but is released at use by opening the grip portion, and of which interior is so constructed as to accommodate accessories to allow easy and secure observation of the accessories when the grip portion is opened prior to the use.

11 Claims, 6 Drawing Sheets

10
11
12
13
14
15
20
21
23
24
30
40
111A
111B
110A
110B
100A
100B 11
110A
100B
14
15
80
50
40
110B
12
51
100A
40
50A
21A
24
12A
21
21S
100

14
15
11
12
40
130
80
50
10
40
130
70
60
21
12A
20

CARRYING CASE

This application is a continuation of application Ser. No. 07/040,761, filed Apr. 20, 1987, which is a continuation of application Ser. No. 06/664,492, filed Oct. 25, 1984, both now abandoned.

BACKGROUND OF THE INVENTION

1. Field of the Invention

The present invention relates to a carrying case, and more particularly to an improvement in the carrying case adapted for housing a portable equipment or instrument such as a typewriter, word processor or personal computer.

2. Description of the Prior Art

As a carrying case for housing a portable equipment for information processing such as typewriter or word processor (hereinafter simply called equipment), there is already known a product composed of two lid members with a transporting handle and hinges at a side opposite to said handle.

In case of transporting an equipment in such carrying case, there are required the steps of closing the upper lid, then locking the upper and lower lid members and carrying said case by suspending the same with the handle portion formed separately from said lid members.

In such a carrying case, the equipment may fall off from the case and be damaged during the transportation if the locking is incomplete. Thus, even when the locking is complete, the user, subjected to psychological stress, has to frequently confirm the state of the locks.

Also the conventional carrying cases have been exclusively designed for housing and transporting the equipment, and lack any consideration for facilitating the operation in case the equipment is operated in the carrying case with the upper lid member open.

In general, prior to the use of equipment such as information processing equipment, the operator is often required to perform certain initial operations such as the selection of accessories according to the form of document to be prepared, namely according to the form of information to be processed. Said initial operations include the selection of type font wheels or balls in case of an impact typewriter, or the selection of type style cartridges for designating the type font and dimension of the thermal heads etc. in case of a non-impact electronic typewriter or a word processor.

Therefore, a suitable structure of the carrying case enabling easy observation of the accessories prevents oversight of the selection of such accessories by the operator.

SUMMARY OF THE INVENTION

The object of the present invention is to provide a carrying case capable of avoiding the aforementioned drawback by means of a grip portion which is so constructed as to hold the upper and lower lid members whereby the locked state of the carrying case is maintained during transportation by the holding force of the operator but is released at use by opening said grip portion, and of which the interior is so constructed as to accommodated accessories to allow easy and secure observation of said accessories when said grip portion is opened prior to the use.

Another object of the present invention is to provide a carrying case provided with a portion constituting a palm rest on which the operator can place his palm during input operation thereby reducing the fatigue of the palm of the operator and improving the operability when the apparatus contained in the carrying case is operated with the upper lid member open.

Still another object of the present invention is to provide a carrying case wherein said palm rest constituting portion is so constructed as to accommodate spare parts or supplies such as ink ribbons thereby improving the storage efficiency of the carrying case and the convenience of use of the apparatus.

DETAILED DESCRIPTION OF THE PREFERRED EMBODIMENTS

Figures 1A, 1B, 1C, 1D:
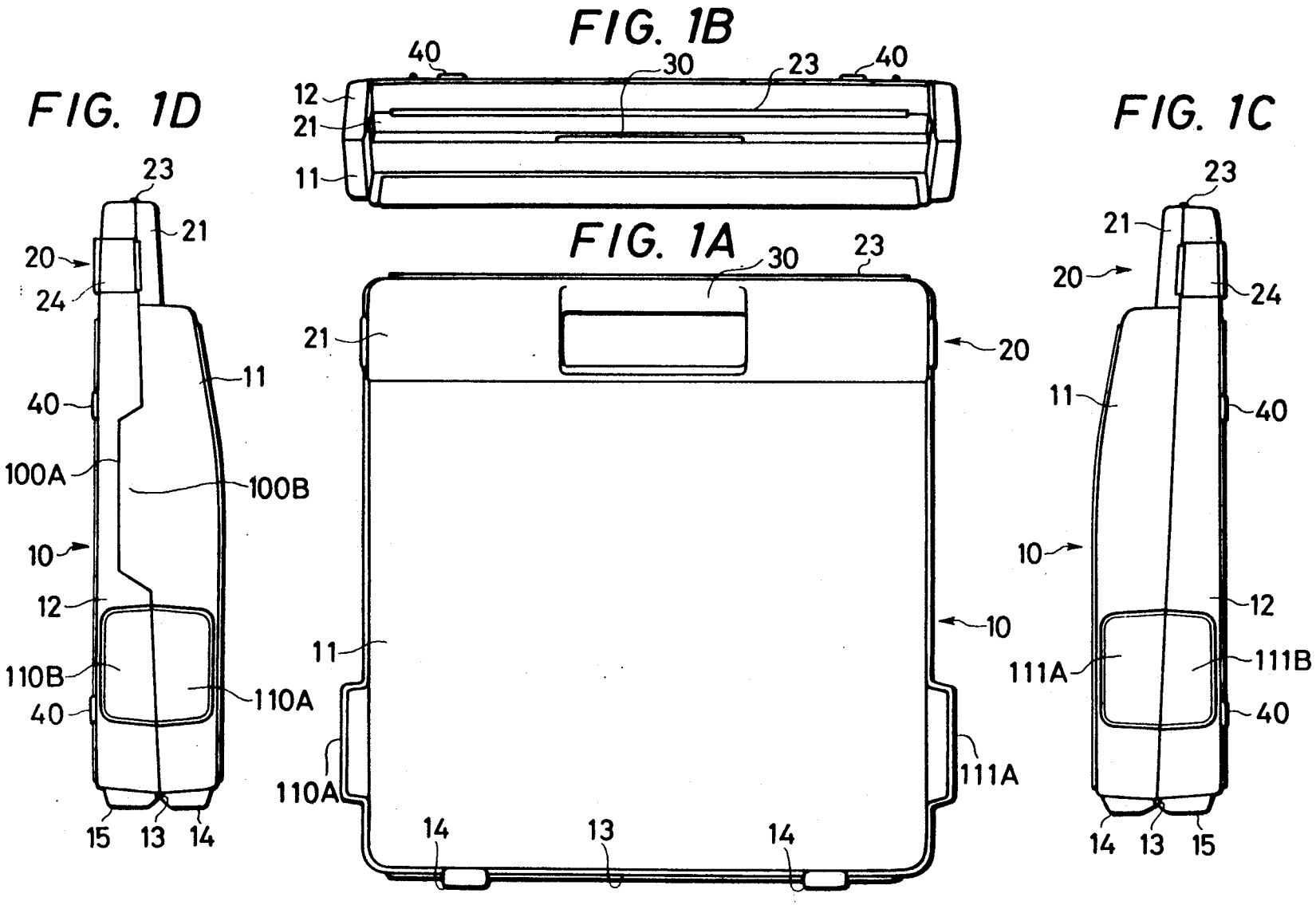
FIGS. 1A, 1B, 1C and 1D are respectively a front view, a plan view, a lateral view of the right-hand side and a lateral view of the left-hand side of a carrying case embodying the present invention.

Now the present invention will be clarified in detail by an embodiment thereof shown in the attached drawings.

FIGS. 1A, 1B, 1C and 1D are respectively a front view, a plan view, a lateral view of the right hand side and a lateral view of the left-hand side of a carrying case of the present invention which is for example designed for holding an electronic typewriter equipped with a keyboard.

There are shown a main body housing portion 10 for housing the main body of the typewriter with a thermal head; a part housing portion 20 for housing accessories; a grip portion 30 provided on said part housing portion; and leg portions 40 which are integrally formed by the process of flow molding a plastic material.

An upper lid member 11 and a lower lid member 12 of the main body, housing portion 10 are openably connected by a hinge 13 at a side opposite to the grip portion 30. Stoppers 14, 15 are respectively provided on the upper and lower lid members 11, 12, whereby the upper lid member 11, when opened for operating the typewriter, rotates about said hinge 13 and stops at a predetermined position where the stoppers 14 meet the stoppers 15. The details of said stoppers will be explained later in relation to FIG. 6. Said stoppers 14, 15 are so shaped to constitute legs for supporting the main body housing portion in a vertical position when the upper and lower lid members 11, 12 are closed.

As shown in FIG. 1C, the lower lid member 12 is extended beyond the upper lid member 11 toward the part housing portion 20, and, at the end thereof at the upper side in FIG. 1, a part housing cover 21 is articulated by a hinge 23, which biases the cover 21 in a direction to open said cover. The part housing cover 21 is provided with a latch 24, which engages with the lower lid member 12 when the cover 21 is closed. The part housing cover 21 may also be articulated by a hinge positioned at a lateral end of the extended portion of the lower lid member 12.

Also the latch 24 may be positioned on the extended portion 12A of the lower lid member 12. There are further provided projecting parts 110A, 110B, 111A, 111B formed on the upper and lower lid members 11, 12 for accommodating the platen knob of the typewriter, a recess 100A for operating switches, etc. provided on a lateral face of the typewriter and a projecting part 100B complimentary to said recess 100A.

Figure 2A:
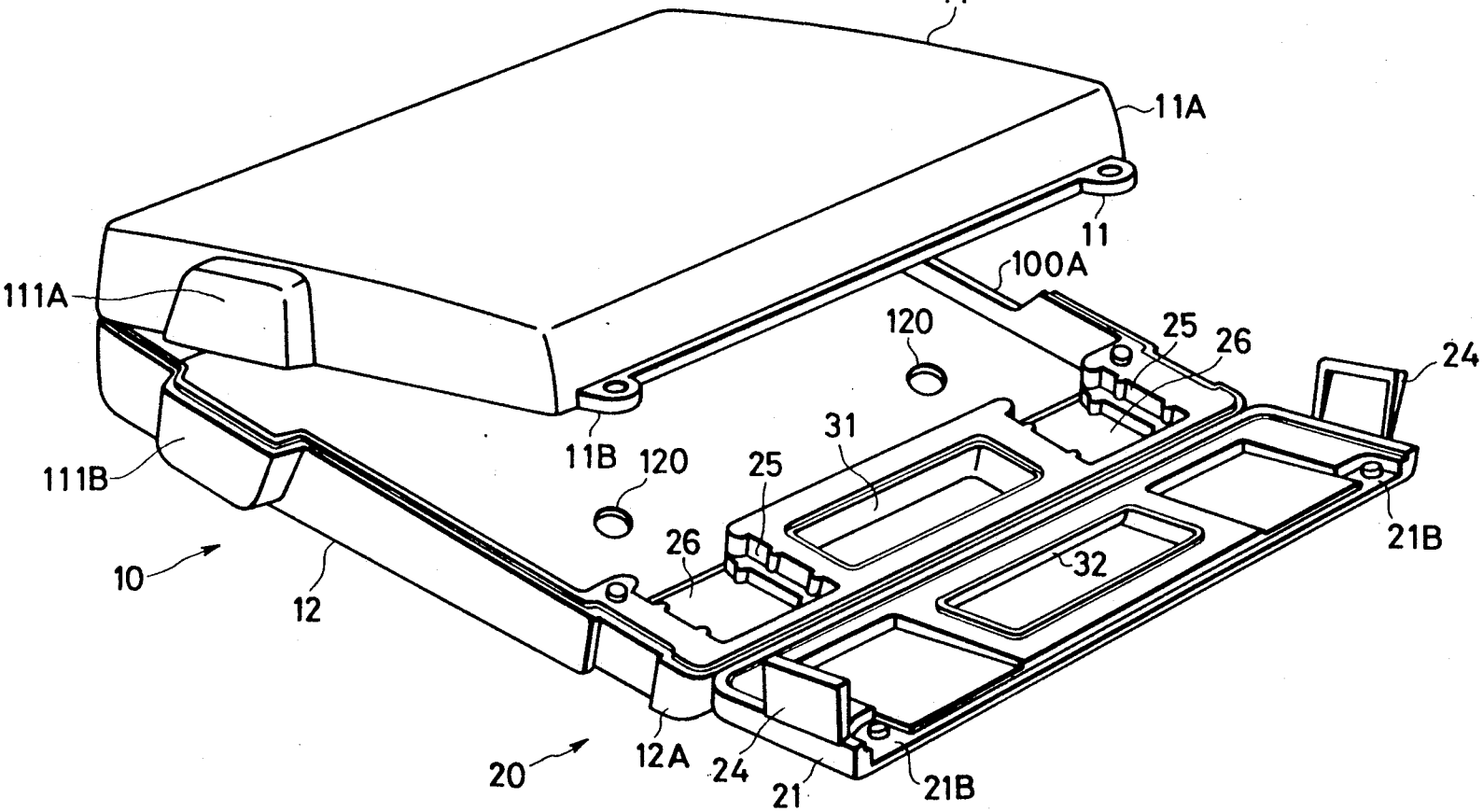
FIGS. 2A and 2B and FIG. 3 are perspective views of said carrying case in which the upper lid member and the parts bin lid are respectively opened and closed.
Figure 2B:
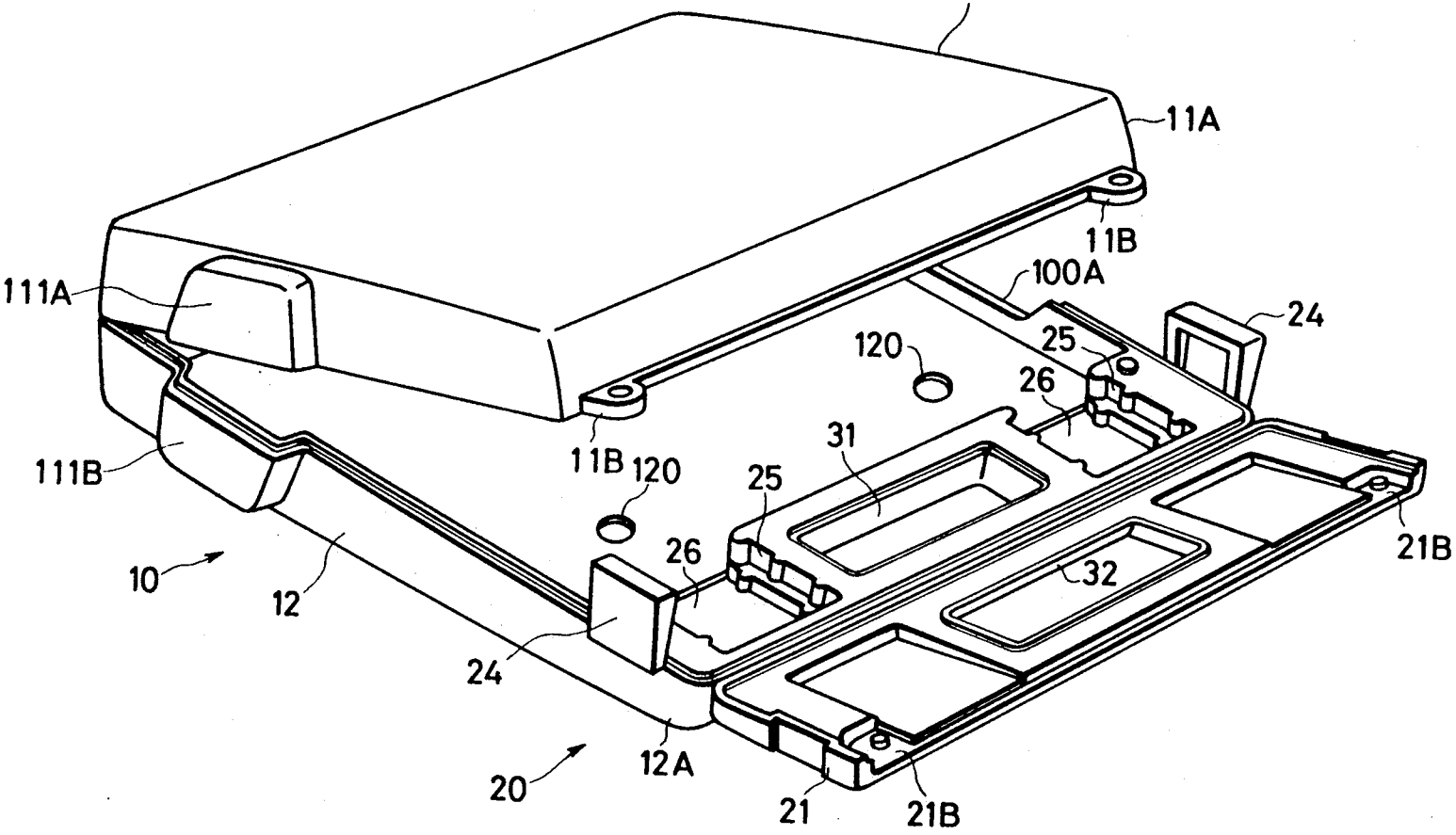

FIG. 2A and 2B show the carrying case of the present invention where the lid members 11, 12 are open. Fingers 11B protrude from a lateral face 11A of the lid member 11 to engage with portions 21B of the cover 21 when the lid members 11, 12 are mutually closed. Inside the extended portion 12A to be covered by the part housing cover 21 of the lower lid member 12, there are provided recesses for housing the parts. Said recesses can be arbitrarily shaped according to the species and shapes of the accessories employed in the apparatus to be housed in the carrying case. In the present embodiment there are provided a recess 25 for housing an ink ribbon cassette, and a recess 26 for housing a type style cartridge functioning as an external memory for the type font and size for the thermal head.

Said recesses may also be used for housing a type font wheel if the typewriter is of the daisy wheel type.

The lid member 12 and the cover 21 are respectively provided with apertures 31, 32 of a size suitable for accepting the hand of the operator, thereby constituting the grip portion 30 for transporting the carrying case.

Holes 120 are provided to engage with legs 130 of the typewriter, thus fixing the typewriter itself.

Also the latches 24 may be positioned on the extended portion 12A of the lower lid member 12 as shown in FIG. 2B.

Figure 3:
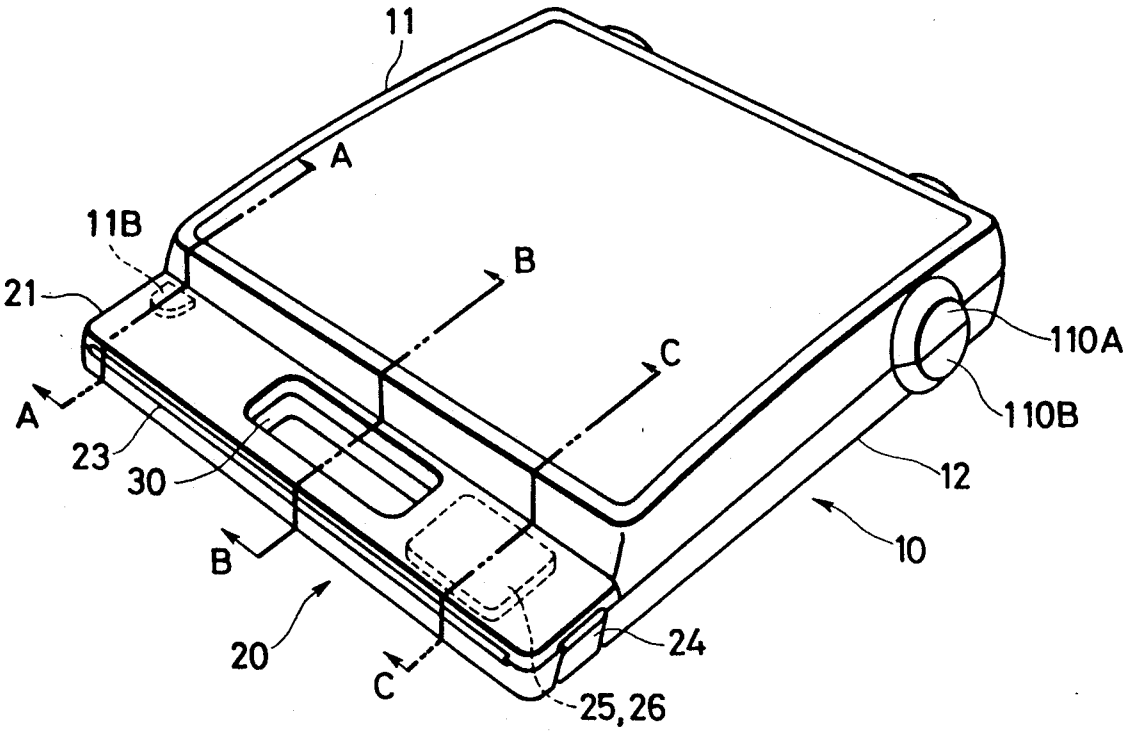

FIG. 3 shows the carrying case of the present invention in a closed state for transportation, wherein lines A-A, B-B and C-C indicate section lines respectively passing through the finger 11B, grip portion 30 and recesses 25, 26.

Figure 4A:
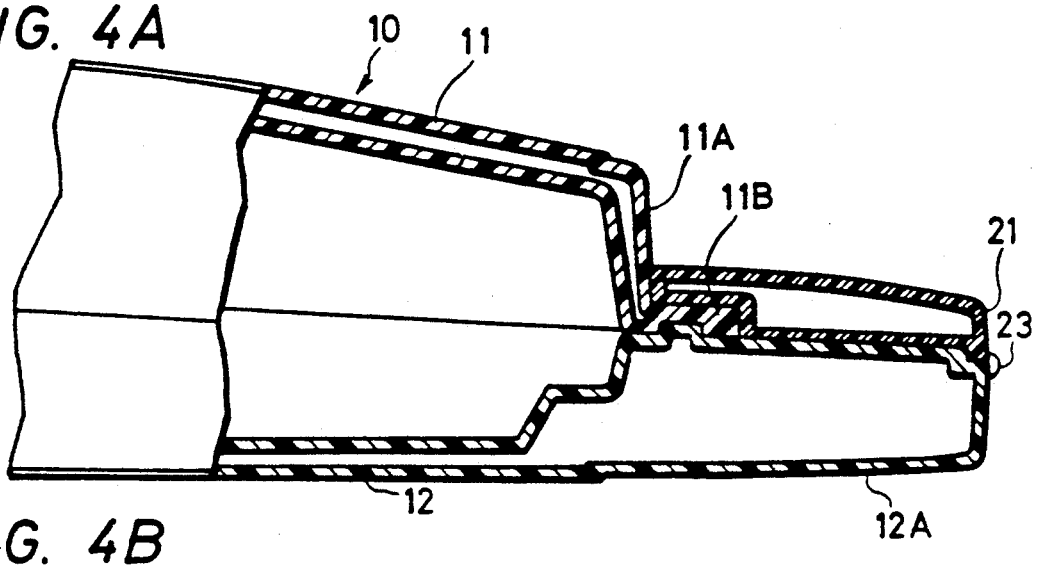
FIGS. 4A, 4B and 4C are cross sectional views showing the cross section of various parts of the carrying case of the present invention.
Figure 4B:
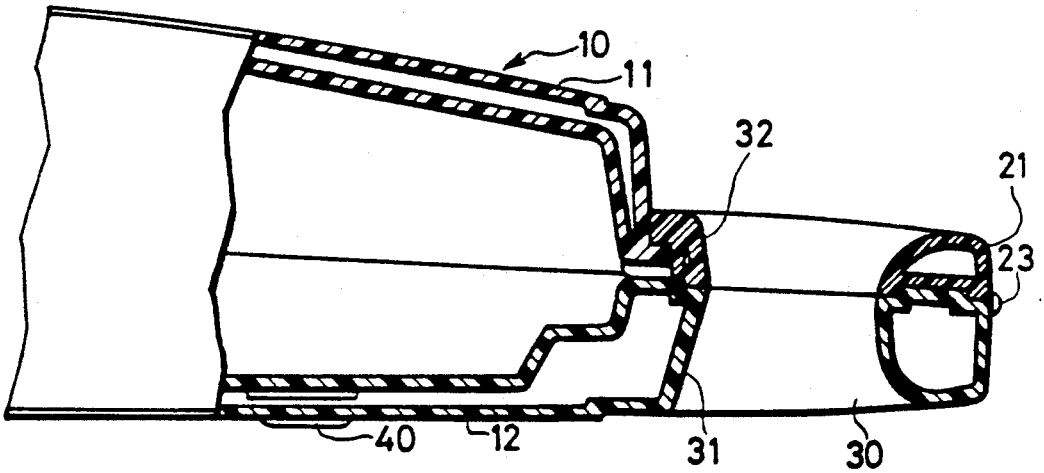
Figure 4C:
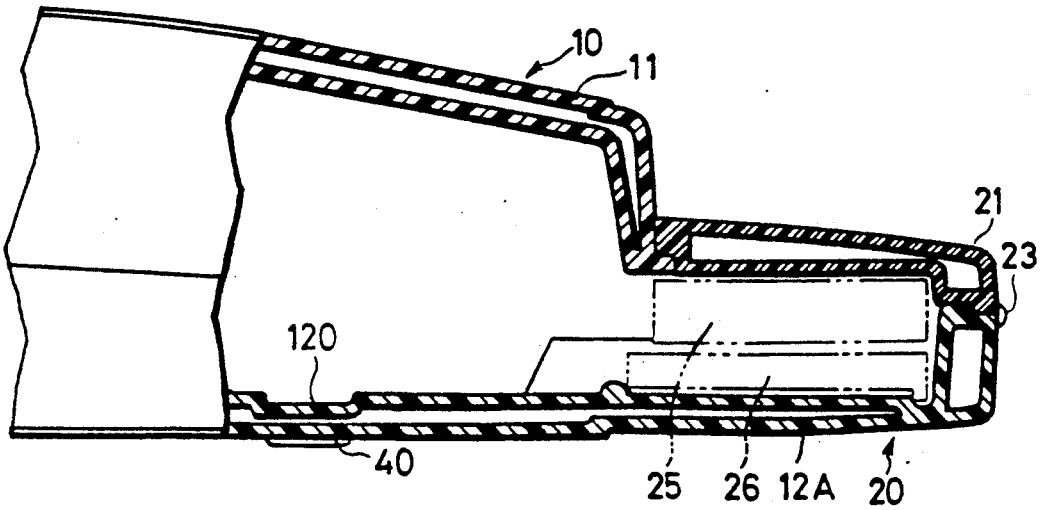

FIGS. 4A, 4B and 4C are cross-sectional views of the carrying case of the present invention respectively along the lines A-A, B-B and C-C in FIG. 3. The carrying case structure is shown having a double-walled construction. In case of closing the lid members 11, 12 which are open are shown in FIG. 2 for the purpose of transportation or the like into a closed state shown in FIG. 3, the operator closes the lid member 11 first and then the cover 21. In such closing operation, the finger 11B engages with the portion 21B of the cover 21 as shown in FIG. 4A, so that the lid member 11 is pressed against the lid member 12 when the operator holds the grip portion 30 for transportation. Stated differently, the lid member 11 cannot be opened unless the cover 21 is opened.

In this manner the locked state is maintained by the holding force of the operator, thus avoiding the possibility the typewriter, or like equipment housed in the carrying case, from falling off of, or out of, the carrying case. In addition a cushioning effect is obtained because of the pores formed by the process of blow molding a plastic material.

Figures 5, 6:
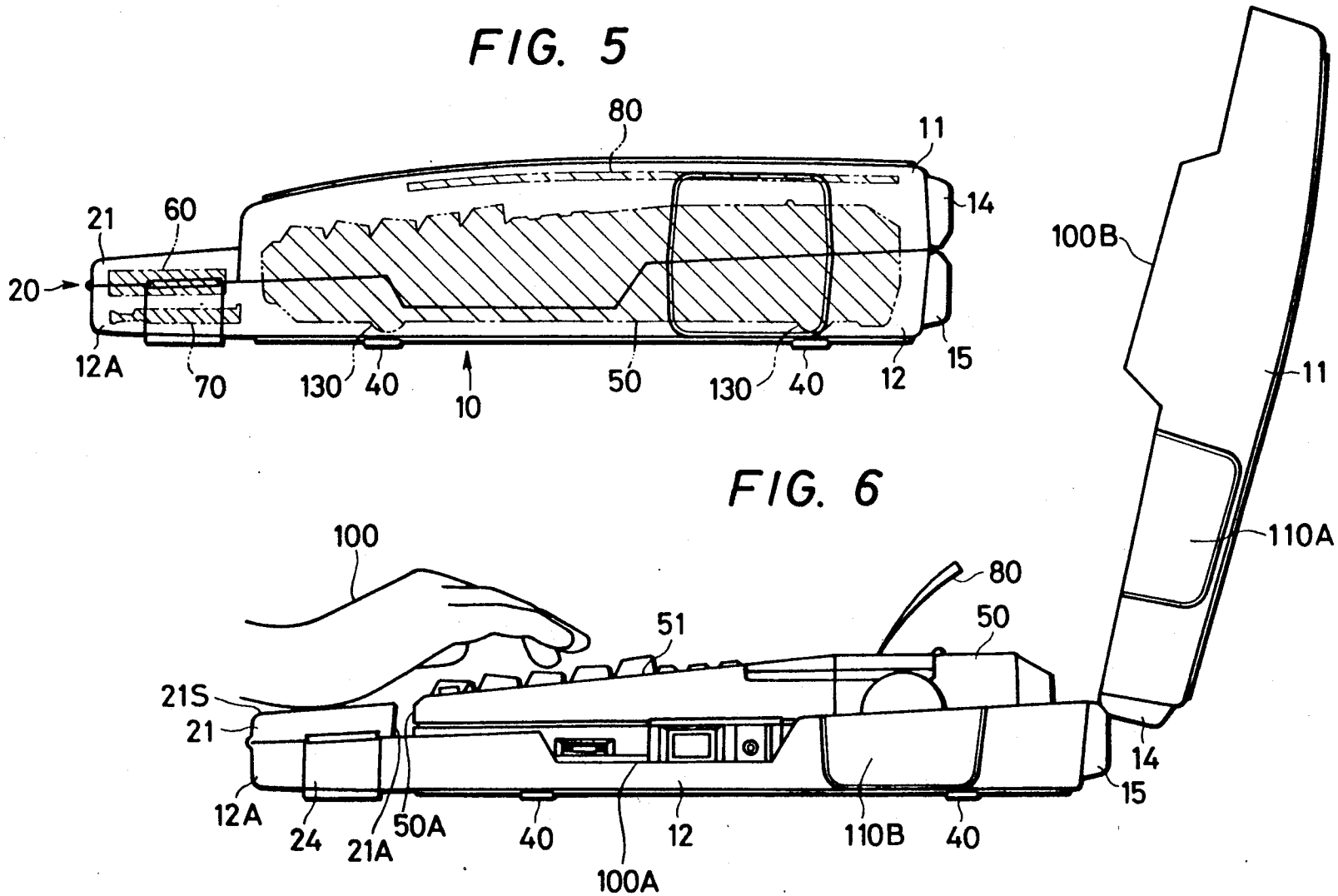
FIG. 5 is a lateral view of the carrying case of the present invention accommodating a typewriter and accessories.
FIG. 6 is a lateral view showing a state in which a typewriter accommodated in the carrying case of the present invention is operated.

FIG. 5 shows an example of housing a typewriter and accessories in the carrying case of the present invention. Hatched areas 50, 60, 70 and 80 respectively show a typewriter, an ink ribbon cassette, a type style cartridge and typewriting papers. The inside of the carrying case may be covered with a cushioning material such as sponge.

FIG. 6 shows a state of exposing the typewriter for operation, which is housed in the carrying case of the present invention as shown in FIG. 5. In this case, the operator first opens the part housing cover 21 and selects necessary accessories. At the same time it is also possible to confirm whether spare supplies of these accessories are stored therein. Then the operator rotates the upper lid member 11 to the stopping position, mounts the selected accessories on the typewriter 50, and closes the cover 21 to start the operation. The recess 100A allows access to the switches or the like provided on a lateral face of the typewriter 50.

Now there will be explained the cover 21 in more detail. The external surface of the cover 21 is rendered smooth sufficient not to irritate the palm 100 of the operator. Otherwise there may be attached a flexible sheet, such as a rubber sheet, as a cushion and anti-slippage material. The shape of the cover 21 can be designed in relation to the shape of the typewriter 50 in consideration of human engineering in order to prevent fatigue of the operator when he places his palm 100 on said cover. As an example, as shown in FIG. 6, the height of the end portion 50A of the typewriter housed in the carrying case is rendered substantially the same as that of the portion 21A of the cover 21 facing said end portion 50A, and the top surface of the cover 21 is inclined toward the operator with an inclination substantially the same as that of the keyboard 51.

Also the latch 24 may be provided on the extended portion 12A of the lower lid member 12, whereby the opening operation can be achieved by the biasing force of the hinge 23 by simply releasing the latch 24.

As explained in the foregoing, the carrying case of the present invention is provided with a grip portion so constructed as to pinch the lid members of the carrying case, whereby the locked state is maintained during transportation by the holding force of the operator but is released by opening the grip portion. Also the interior of said grip portion is used for housing accessories of the apparatus housed in the carrying case. Consequently there is provided a carrying case which is highly safe during transportation and allows easy and secure observation of the accessories during use.

In addition the upper lid member of the main body housing portion is supported in front of the operator at a determined angle by means of the stoppers, so that the operator can place the original documents inside said upper lid member, thereby improving the convenience of the operation.

In the foregoing embodiment, the carrying case is assumed to house a typewriter, but the present invention can achieve similar effects when applied to other carrying cases designed for housing information processing apparatus such as a word processor, a personal computer, pocket computer a or the like, or other instruments such as a portable measuring instrument.

Furthermore, in the foregoing embodiment, the upper and lower lid members and the part housing cover constitute three principal components which are integrally linked through hinges, but the present invention is by no means limited to such structure but can be applied in other structures. As an example, the part housing cover need not be hinged as shown in the foregoing embodiment but can be formed as a slidable or detachable member engaging with the extended portion.

Furthermore, as explained in the foregoing, the carrying case of the present invention is provided with a portion constituting a palm rest on which the operator can lay his palm during the key operation, and is therefore capable of reducing fatigue of the palm of the operator and significantly improving the operability of the apparatus and the efficiency of information processing in case key operations by opening the upper lid member to expose the apparatus housed therein.

Furthermore, in the foregoing embodiment, the portion constituting the palm rest is so constructed as to accommodate accessories of the apparatus, thereby improving the housing efficiency of the carrying case and the performance of the apparatus at use.

The carrying case of the present invention can also be utilized for an apparatus equipped with an input board for example of so-called pen-touch type.

What we claim is:

1. A carrying case comprising:

first lid means for supporting equipment having one side provided with an input operation board, said first lid means having a first extension part unit fixed thereto, a second extension part unit hingedly connected on said first extension part unit, and means for hingedly connecting said first extension part unit and said second extension part unit;

second lid means, shaped so as to cover the side of the equipment having the input operation board, for enclosing the equipment in cooperation with said first lid means and for exposing the input operation board of the equipment when opened; and palm rest means, integral with said first and second extension part units, for allowing the palm of an operator of the equipment to be rested thereon during an input operation of the input operation board, said palm rest means latching said first and second extension part units during the input operation and latching said second lid means in a closed state when the operator is not using the equipment.

2. A carrying case according to claim 1, wherein said first extension part unit extends beyond said second lid means, and said palm rest means is provided on an outer side of said second extension part unit.

3. A carrying case according to claim 1, wherein said second extension part unit covers said first extension part unit in a closed state and defines a space therebetween to accommodate accessories of the equipment.

4. A carrying case according to claim 1, wherein said carrying case is formed by the process of blow molding of a plastic material.

5. A carrying case according to claim 1, wherein said carrying case has a double-walled structure.

6. A carrying case comprising:

first lid means for supporting equipment having an input operation board, said first lid means having a first extension part unit and a second extension part unit, and having a hinge means for connecting said first and second extension part units to each other, with said first extension part unit being fixed to said first lid means;

second lid means, shaped so as to cover the side of the equipment having the input operation board, for enclosing the equipment in cooperation with said first lid means and for exposing the input operation board of the equipment when opened, said second lid means including first latching members to be latched on said first lid means; and latch means, provided on said first lid means and including second latching members for receiving said first latching members when said second lid is closed, for latching said second extension part unit to said first extension part unit, wherein said first latching members are engaged by said first and second extension part units when said second lid means is in a closed state.

7. A carrying case according to claim 6, further comprising a palm rest.

8. A carrying case according to claim 7, wherein said palm rest has an accessories accommodation portion.

9. A carrying case comprising:

first lid means capable of supporting an equipment having one side provided with an input operation board, by covering a side of the equipment not having an input operation board;

second lid means so shaped as to cover the side of the equipment having the input operation board and capable of enclosing the equipment in cooperation with said first lid means and of exposing the side of the equipment having the input operation board when opened;

third lid means provided on said first lid means for restraining said second lid means in a closed state thereof; and latch means for latching said third lid means to said first lid means, said third lid means being unlatched by bending said latch means in the right and left directions with respect to the opening direction of the second lid means.

10. A carrying case according to claim 9, further comprising a palm rest.

11. A carrying case according to claim 10, wherein said palm rest has an accessory accommodation portion.

* * * * *

UNITED STATES PATENT AND TRADEMARK OFFICE

CERTIFICATE OF CORRECTION

PATENT NO. : 5,074,413

DATED : December 24, 1991

INVENTOR(S) : Tamao Ikuta, et al.

It is certified that error appears in the above-identified patent and that said Letters Patent is hereby corrected as shown below:

Title page, item

[56] REFERENCES CITED:

U.S. PATENT DOCUMENTS, "Chuilicek" should read --Chvilicek--.

Title page, item

[63] RELATED U.S. APPLICATION DATA:

"continuation-in-part" should read --continuation--.

COLUMN 2:

Line 47, "flow" should read --blow--.

Line 64, "FIG. 1," should read --FIG. 1C,--.

COLUMN 3:

Line 12, "FIG. 2A" should read --FIGS. 2A--

Line 60, "bility the" should read --bility of the--.

COLUMN 4:

Line 50, "determined" should read --predetermined--.

COLUMN 5:

Line 53, "of" should be deleted.

UNITED STATES PATENT AND TRADEMARK OFFICE

CERTIFICATE OF CORRECTION

PATENT NO. : 5,074,413

DATED : December 24, 1991

INVENTOR(S) : Tamao Ikuta, et al.

It is certified that error appears in the above-identified patent and that said Letters Patent is hereby corrected as shown below:

COLUMN 6:

Line 20, "second lid" should read --second lid means--.

Signed and Sealed this

First Day of June, 1993

*Attest:*

Michael K. Kirk

MICHAEL K. KIRK

*Attesting Officer*

*Acting Commissioner of Patents and Trademarks*